United States Patent [19]

Owensby et al.

[11] Patent Number: 4,616,472

[45] Date of Patent: Oct. 14, 1986

[54] METHOD AND APPARATUS FOR LOADING SIDE-SEAL BAGS

[75] Inventors: Joseph E. Owensby, Spartanburg; Frederick A. Dobbins, Lyman; Billy W. Austin, Duncan, all of S.C.

[73] Assignee: W. R. Grace & Co., Cryovac Div., Duncan, S.C.

[21] Appl. No.: 786,383

[22] Filed: Oct. 10, 1985

[51] Int. Cl.[4] ..... B65B 43/34; B65B 43/36; B65B 43/16; B65B 43/22

[52] U.S. Cl. ..... 53/459; 53/468; 53/571; 53/570

[58] Field of Search ..... 53/570, 385, 459, 469, 53/202, 562, 571

[56] References Cited

U.S. PATENT DOCUMENTS

| | | | |
|---|---|---|---|
| 2,667,997 | 2/1954 | Vogt | 53/570 X |
| 2,671,588 | 3/1954 | Vogt | 53/570 X |
| 2,754,644 | 7/1956 | Vergobbi et al. | 53/570 X |
| 3,033,257 | 5/1962 | Weber . | |
| 3,160,273 | 12/1964 | Reuther et al. . | |
| 3,197,936 | 8/1965 | Messmer | 53/570 X |
| 3,453,799 | 7/1969 | Cloud et al. | 53/570 X |
| 3,647,060 | 3/1972 | Kiely . | |
| 3,728,840 | 4/1973 | Izumi | 53/570 X |
| 3,774,367 | 11/1973 | Lerner | 53/570 X |
| 4,011,708 | 3/1977 | Brown, Jr. | 53/570 |
| 4,387,550 | 6/1983 | Lerner | 53/570 X |
| 4,493,684 | 1/1985 | Bolton . | |

FOREIGN PATENT DOCUMENTS

| | | |
|---|---|---|
| 2080179 | 8/1983 | United Kingdom . |

*Primary Examiner*—Horace M. Culver

*Attorney, Agent, or Firm*—John J. Toney; William D. Lee, Jr.; Mark B. Quatt

[57] ABSTRACT

A method and apparatus for automatically loading side seal bags, at least two at a time, which comprises delivering the bags to a first position below a rod conveyor which has a gap therein through which the bags are pulled and loaded in a second position. The bags are then conveyed away on the rod conveyor. Speed of loading is increased because succeeding bags are moved to the first position while the previous bags are loaded at the second position. The movement from the first to second position is short and relatively quick.

10 Claims, 10 Drawing Figures

METHOD AND APPARATUS FOR LOADING SIDE-SEAL BAGS

FIELD OF INVENTION

This invention relates to a method and apparatus for loading products into side-seal bags. More specifically, this invention relates to a method and apparatus for simultaneously loading products into each bag in a plurality of bags which are fed from a chain of side-seal bags.

BACKGROUND OF THE INVENTION

In making bags from thermoplastic film two basic bag configurations are often used. One bag configuration is the end-seal bag where a seamless tube of thermoplastic material is sealed and severed in the lay-flat condition at discrete intervals along its length to form bags. The other configuration is the side-seal bag where a sheet of film is folded so that the fold forms the bottom of the bag and then a series of seals are made transversely to form the sides of the bag. Examples of both of these types of bags are shown in U.S. Pat. No. 3,979,058 which issued on Sept. 7, 1972 to Philip F. Cilia. Another example of a side-seal bag is shown in U.S. Pat. No. 3,647,060 which issued on Mar. 7, 1972 to Robert R. Kiely.

A bag which is a combination in some respects of both the side-seal and end seal bag is one which is formed by collapsing a seamless tube to a lay-flat condition, removing a narrow longitudinal strip from one side of the lay-flat tube, the strip being transversely spaced from one side of the lay-flat tube at a distance equal to the desired lip extension and then transversely sealing the tube at regular longitudinal intervals to create a series of bags. One of the advantages of the side-seal bags is that they can be made in a detachable or dispensable form by providing perforations or serrations between the two adjacent side seals of side-by-side bags in a chain of bags. Such arrangements are shown in U.S. Pat. No. 3,033,257 which issued on May 8, 1962 to H. H. Webber and in U.S. Pat. No. 3,160,273 which issued on Dec. 8, 1964 to R. H. Reuther et al. Still other appropriate examples of this type of bag are found in U.S. Pat. No. 4,493,684 which issued on Jan. 15, 1985 to Roderick A. Bolton and in Spanish Utility Model No. 259,143 which issued on Apr. 23, 1982 in the name of W. R. Grace and Co.

Because side-seal bags are readily detachable, can be made in a variety of widths and lengths, and can be supplied in a roll without the necessity of tapes, clips, or wickets they have received a great deal of attention for automatic loading processes. One example of an apparatus for separating and loading bags of a chain of side-seal bags is U.K. Pat. No. 2,080,179. A method for loading such bags is disclosed in U.K. Pat. No. 2,087,654.

It is a general object of the present invention to utilize a chain of side-seal bags, particularly side-seal bags that have a lip which can be gripped, in a relatively high-speed process.

It is another object of the present invention to load a plurality of side-seal bags simultaneously.

It is still another object of the present invention to provide a method and apparatus in which one plurality of bags is being brought to a loading station while a preceding plurality of bags is being loaded in the station.

These and other objects and advantages of the present invention will be more readily understood from the following Summary of the Invention, Description of the Drawings, and Description of the Preferred Embodiment.

SUMMARY OF THE INVENTION

It has been surprisingly and unexpectedly found that a method of loading a series of bags, each bag having a lip which can be gripped so that the mouth of the bag is unobstructed, can be performed by providing a rod conveyor having a gap where there are no rods; delivering a first bag to a first position of the upper run of the conveyor; gripping the lip of the first bag and pulling the first bag through said gap to a second position at least partially on the conveyor; delivering a second bag to the first position under the upper rod of the conveyor while opening and loading the first bag; and conveying the loaded first bag away while pulling the second bag through the gap to the second position to be loaded.

In another aspect, the method of the present invention is a method of simultaneously loading products into each bag of a plurality of bags comprising the steps of: providing a chain of separable side-seal bags each having a lip which can be gripped leaving the mouth of the bag unobstructed for opening; separating a plurality of the bags from the chain; gripping the lips of each of the bags in the plurality so that the bag mouths are not obstructed; simultaneously opening each of the bags in the plurality of bags; simultaneously loading a product into each of the opened bags; releasing each gripped bag; and separating each bag in the plurality of bags from each other. One advantageous method of opening the bag is by directing a stream of air across the bag mouth. Another advantageous way of performing the method is to perform it while each of the bags is in a horizontal position.

In still another aspect, the present invention is an apparatus for loading a product into a bag having a lip which can be gripped leaving the mouth unobstructed comprising a rod conveyor having a gap where there are no rods; means for delivering a bag to a first position above the upper run of the conveyor; means for gripping the lip of the bag at the first position and for pulling the bag through the gap in the conveyor to a second position where the bag is at least partially on the conveyor; means for opening the bag; and, means for placing a product in the opened bag.

DESCRIPTION OF THE DRAWINGS

The features of the present invention in the following detailed description can be more fully appreciated by reference to the following drawings which are appended hereto and made a part of this disclosure wherein.

DESCRIPTION OF A PREFERRED EMBODIMENT

Figure 1:
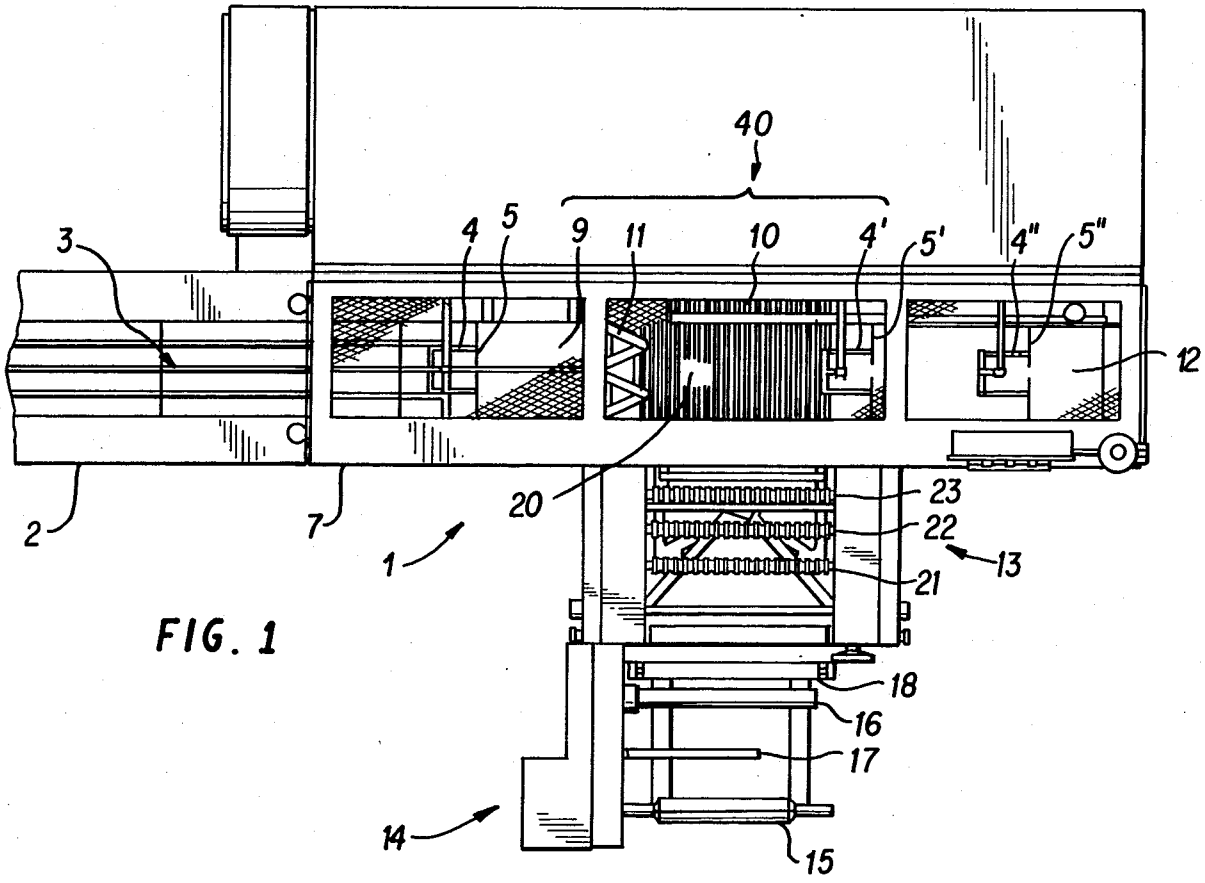
FIG. 1 is a top plan view of a preferred embodiment of the apparatus of the present invention.

Looking first at FIG. 1, a preferred embodiment 1 of the bag loading apparatus of the present invention is shown from a top plan view. Product to be packaged arrives on infeed conveyor 2 separated by tray dividers 3. The infeed conveyor 2 as shown in this drawing is a partial section and only the part of the infeed conveyor immediately adjacent the apparatus 1 is shown. Upstream of the infeed conveyor is the loading station where operators place the product to be packaged in or on the conveyor. As shown, the conveyor is set up to carry two side-by-side products, i.e. two streams of product will flow on the conveyor, each stream headed towards an opened bag. The charge for a bag or rather the "load" for a bag is the product which has been placed in the tray between the dividers 3.

Figure 2:
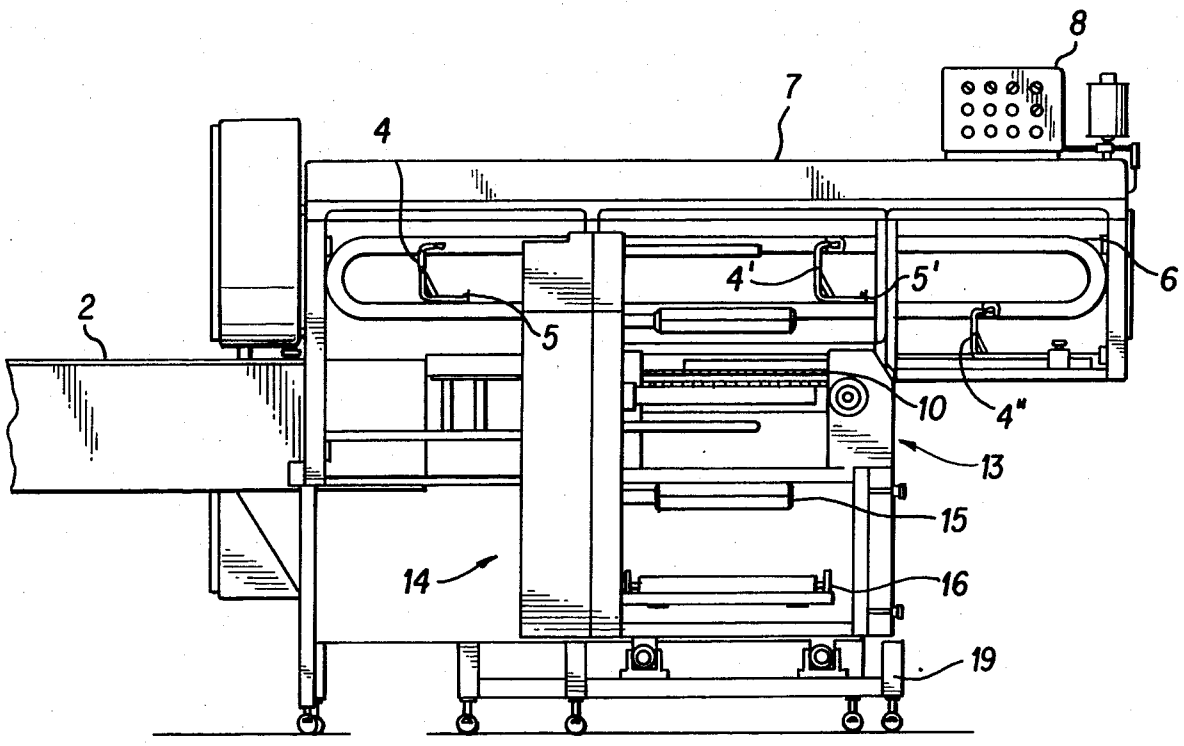
FIG. 2 is a side elevation view of the preferred embodiment shown in FIG. 1.
Figure 3:
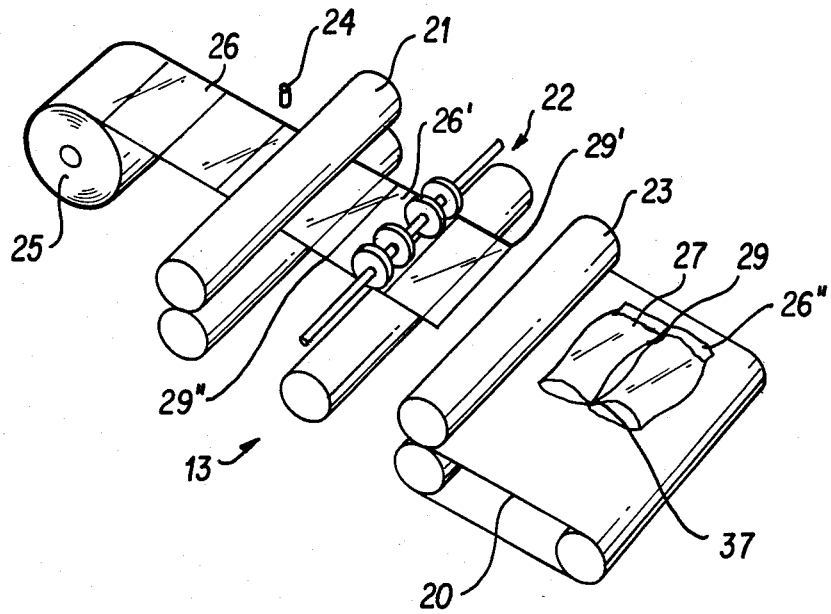
FIG. 3 is a schematic representation of the apparatus for detaching and partially separating side-seal bags which apparatus is part of the preferred embodiment of FIGS. 1 and 2.

In both FIGS. 2 and 3, pusher paddle 4 with pusher paddle face 5 is shown. There are a series of the pusher paddles arranged on conveyor 6 and the additional pusher paddles which are shown in FIG. 2 are designated 4' with paddle 5' and also 4''. These pusher paddles as they travel on the conveyor are lowered and timed to be in position to immediately follow a product so that when a product arrives at the product transition base plate 9 the pusher paddle will move it into a waiting, opened bag as will be described more fully hereinafter.

Still viewing FIGS. 1 and 2, bag openers 11 are shown to the right of or downstream from the product transition base plate 9. These bag openers act like pivotally mounted shoe horns to open and hold stable the mouths of the flexible thermoplastic bags while the product is loaded into them while being pushed by the paddles 4. As can be seen in FIG. 1, the pusher paddles 4 and the pusher paddle faces 5 come in pairs as the embodiment of the present invention shown in FIGS. 1 and 2 is for two streams of product. However, a plurality of streams can be used so that 3, 4, 5, or more streams, paddles, and bag openers could be provided.

Continuing to the right or downstream of the product transition plate 9 is rod conveyor 10 which is a moving conveyor similar to a conveyor belt but with rods transversely spaced apart serving as the conveyor surface. In conveyor 10 there is a gap 10' where there are no rods as illustrated in FIGS. 4–7 and the purpose and function of the gap 10' will be described below.

The conveyor 10, after bags have been filled, conveys the filled or loaded bags to discharge table 12. The pusher paddles move along with the bag and product to this point.

Unwind assembly 14 in which a roll of side-seal serrated bags is held and from which the bags are paid off or fed is located so that the bags are fed transversely to the direction of the flow of the products with their mouths opened toward the products. A roll of bags is mounted on axle 15 and the bags are fed around guide roll 17 over take-up roll 16 and back across another guide roll 18 into the bag separator assembly 13 which comprises three pairs of driven rollers, roller pairs 21, 22, and 23 whose function will also be described below.

The bag loading apparatus 1 is carried by support for main frame 19.

Figure 8:
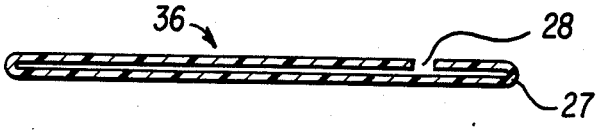
FIG. 8 is a side view in section of a side-seal bag having an extended lip for gripping.
Figure 9:
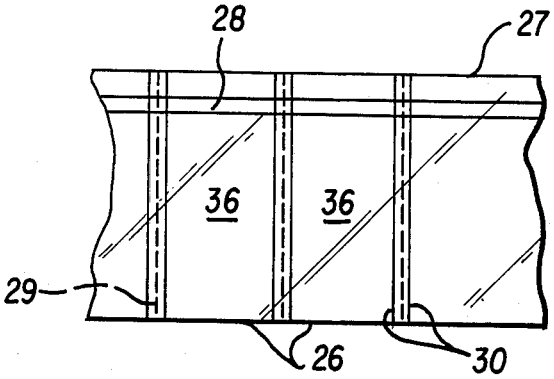
FIG. 9 is a chain of side-seal bags of the type shown in FIG. 8.
Figure 10:
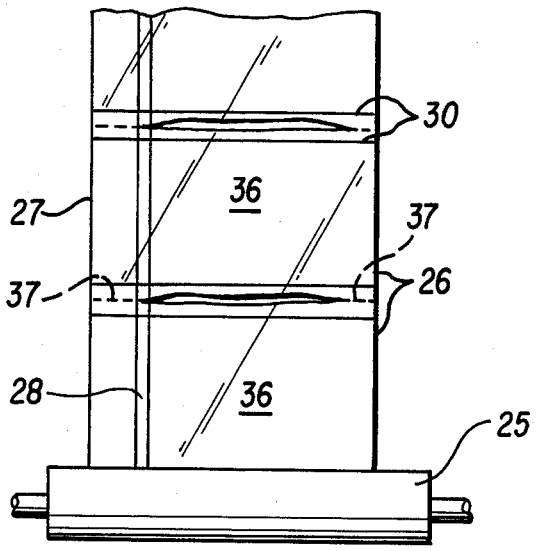
FIG. 10 is a roll of side-seal bags showing the serrations partially opened.

To fully appreciate the configuration of the bags referred to herein, reference at this point will be made to FIGS. 8, 9, and 10 where in FIG. 8 a side view of a flattened bag is shown in section. As can be seen, the bag is essentially a flattened tube with the bag mouth 28 being the place where a strip of material has been removed as can be appreciated by viewing FIG. 9. The lip to be gripped is designated as lip 27 which is the portion of the bag extending beyond the bag mouth. This lip 27 can be gripped without obstructing bag mouth 28. In FIG. 9, the reason for designating these bags as side-seal bags is apparent. Seals 30 are usually heat seals which define the side of a bag generally designated as bag 36. Serrations or perforations 29 between the seals 30 are provided so that the bags may be readily separated one from the other. FIG. 10 shows a roll of such bags with the serrations partially torn or pulled apart but with the bag chain still in tact.

Looking now at FIG. 3 the operation of the bag separator assembly 13 will be described. FIG. 3 is a schematic representation of the separator assembly shown in FIGS. 1 and 2 showing the operation of the separator. Bags are fed from roll 25 and in FIG. 3 the guide rolls and take-up roll are not shown. The purpose of the guide rolls and take-up roll is to keep a constant tension in the chain of bags between the bag roll 25 and the first pair of rollers 21 to insure even and consistent winding and flow of the chain. In feeding the bags from roll 25 the bags are fed in pairs 26 which are designated 26' and 26'' as they are advanced from left to right in FIG. 3. In the automatic operation of the process a photoeye 24 senses an eye spot which is between each pair of bags. Of course, this can be done manually by tearing off a pair of bags in the same manner that paper towels are dispensed from a roll. In the preferred apparatus, roller pairs 21, 22, and 23 are rolled in unison until the photoeye sees the eye spot. Then, roll pairs 21 and 22 stop while roller pair 23 continues its rotation. The continued rolling of pair 23 will separate the pair 26'' from the pair 26' along the serration 29'. At this point in time where roller pairs 21 and 22 stop, vacuum belt conveyor 20 advances or delivers the bag pair 26'' to the loading station area under the rod conveyor 10 as will be described. When roller pairs 21 and 22 stop, and the continued action of roller 23 separates pair 26' from pair 26'', roller pair 22 first momentarily indexes or rotates forward a few degrees to separate the bags in the pair 26' at or along serration 29'' so that the bags at this point will have the appearance as shown in FIG. 10 where the serration is partially pulled apart. After indexing forward, roller set 22 returns to its original position waiting for the next cycle to begin in which the next pair of bags will be separated. Alternately, the bags can be separated in pairs or pluralities and delivered to the loading station with the bags within a plurality being partially separated.

The pair of bags 26'' on vacuum belt 20 are advanced to the loading station. Vacuum belt 20 is a belt with slots therein running in a longitudinal direction and being aligned so that the slots match up with the holes in a vacuum manifold box below the belt which is not shown. This keeps the bag in proper position lying flat on the belt as it is moved in a horizontal plane to the loading station and is to be held there.

Figure 4:
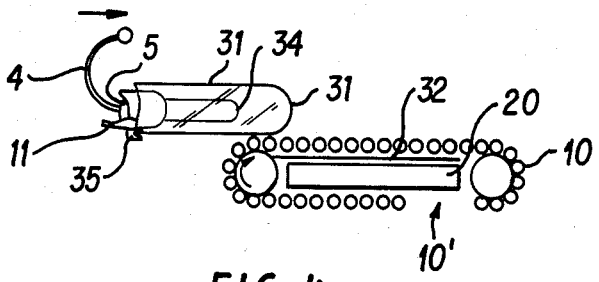
FIGS. 4–7 are schematic representations of the movement of a plurality of bags from below the upper run of the rod conveyor which is included in the preferred embodiment to a position above the rod conveyor to be loaded with products.

The operation at the loading station will next be described. The loading station generally comprises the area including the rod conveyor and the product transition table 9 where the product leaves the infeed conveyor 2 and is placed within a bag. A schematic representation of the action which takes place at the loading station is shown in FIGS. 4–7. FIG. 4 is a vertical section through the roller conveyor 10 giving an edge view showing the gap 10' in the conveyor positioned on the lower run of the conveyor. The upper run of the rod conveyor 10 is above the vacuum belt 20 which is seen edgewise in this view. In this view the advanced bag pair 26" is designated for illustrative purposes as bag 32 in its lay-flat condition and in FIGS. 4–7 will be described as if there is but one bag undergoing the process but it will be understood that a bag pair or bag triplet could be used here. Bag 32 as stated is shown edgewise in its lay-flat position on top of vacuum belt 20 being held in position below the upper run of conveyor 10. Bag 32 is further designated as "second" bag 32. First bag 31 is shown above the upper run of the conveyor 10 in its inflated, opened condition with product 34 being inserted therein. Product 34 is a product such as a large sausage. The bag is being held open or, rather, its mouth is being stabilized by bag openers 11 and the product is being pushed through the openers by the action of paddle pusher 4. Gripper 35 is holding first bag 31 in this position.

Figure 5:
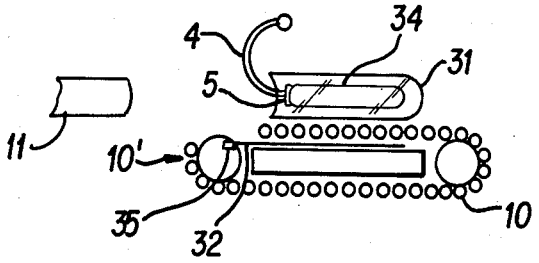
Figure 6:
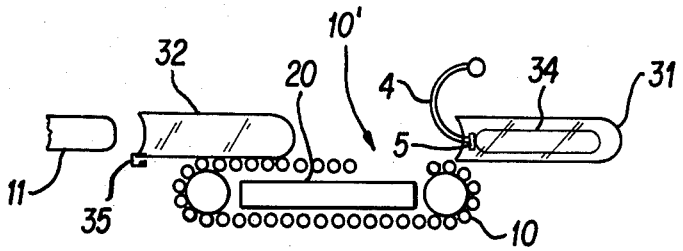

Moving now to FIG. 5, bag 31 has moved along the conveyor along with the paddle pusher 4 having face 5 to push the product 34 at the same speed that the conveyor is traveling. At this point, the bag openers 11 are closed as in FIG. 1 and gripper 35 has released the bag 31 and has moved into position through the gap 10' to secure the lip of the second bag 32. In FIG. 5 the gap 10' is now moving to the upper run of the conveyor and it is through the gap 10' that the gripper will pull the second bag 32 into position. The position will be now as shown in FIG. 6. While moving from the FIG. 5 position to the FIG. 6 position a stream of air is directed across the mouth of the second bag 32. The jet is not shown which does this but is located immediately downstream of openers 11. This causes the bag to be inflated to the position as shown in FIG. 6. At the same time in FIG. 6 the gap 10' has now moved across the upper run and the first bag 31 with product 34 is being moved off onto the discharge table 12 which is preferably a take-away conveyor running at slightly higher speed than the paddle conveyor so that the bag will clear the paddle conveyor. The discharge table 12 can also be an inclined chute which can feed the bags to another conveyor which is lower and not shown. The action of either the discharge table conveyor or chute will serve to separate the remaining unseparated portions 37 (See FIGS. 3 and 8) between bags in the plurality of serrated bags. Also, as an alternate the bags in each plurality can be manually separated.

Figure 7:
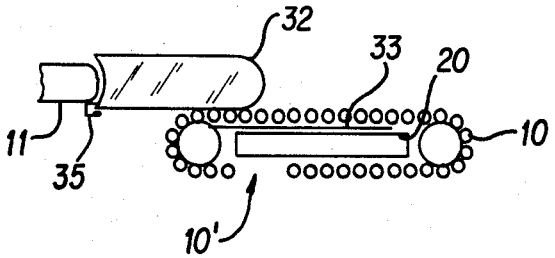

In FIG. 7, third bag 33 has been moved into place by the vacuum belt 20 and is waiting there while bag 32 is loaded. In this position, the gripper 35 is moved to the left and to the bag opener area to bring the inflated mouth of the bag to the openers 11. As can be appreciated by the view in FIG. 1 the openers 11 are a pair of pivotally mounted spring loaded members resembling two shoe horns that contact each other at their downstream ends so that each pair is pointed downstream and a bag can be brought across them and as the product is pushed through the openers 11 by the paddles 4 the bag openers spread open and contact the edges of the mouth of the bag and hold it stably so that the product can go directly into the bag.

By bringing the third bag 33 into position while the second bag 32 is being loaded increases the speed at which the operation can be performed. As can be seen in the operation described in FIGS. 4–7 the first bag is being conveyed away while the second bag is being inflated and opened to receive a product while the third bag is being moved into position. All of this accomplished at the loading station. If straight horizontal movement in the same plane were used to bring a bag or bags to the loading station, the process would have to be delayed until the conveyor had moved the previous bag completely out of the way. In the process of the present invention the succeeding bag is pulled into position through the gap in the conveyor to the bag openers and advanced upstream thus clearing the previous bag. Such an operation can, of course, be performed manually but it is preferred that it be performed by the apparatus of the present invention.

What has been described hereinabove is the method of operating the preferred embodiment of the apparatus. The various timing mechanisms, cams, gears, etc. are not described herein in detail as they are within the skill of one in the art who will readily understand how to place and time such mechanisms once the method of the present invention is understood.

Having thus described our invention:

1. A method of simultaneously loading products into each bag in a plurality of bags comprising the steps of:

(a) providing a chain of individually separable side-seal bags, each bag having a lip which can be gripped so that the mouth of the bag is unobstructed and can be readily opened;

(b) feeding a plurality of bags from the chain, the plurality lying in a first horizontal plane;

(c) separating the plurality of bags from the chain and partially separating the bags within the plurality from each other;

(d) advancing said plurality of bags to a product loading station;

(e) holding said plurality in the first horizontal plane at the loading station while the immediately preceding plurality of bags is being loaded;

(f) gripping the lip of each of the bags in the plurality so that the mouths of the bags are not obstructed;

(g) after the preceding bags have been loaded and removed, moving the plurality of bags upwardly to a second horizontal plane;

(h) opening each of the plurality of bags with a stream of air;

(i) guiding a product into each bag; and, (j) removing the plurality of loaded bags from the loading station and separating each bag in the plurality from the other.

2. The method of claim 1 including the step of providing a rod conveyor at the loading station, said rod conveyor having a gap where there are no rods and wherein:

step (e) is performed by holding the plurality below the upper run of the rod conveyor;

step (g) is performed by pulling the plurality through the gap in the rod conveyor by the gripped lips to the second horizontal plane.

3. The method of claim 2 where the plurality of bags consists of two bags.

4. A method of loading products into bags comprising the steps of:

(a) providing a series of bags, each bag having a lip which can be gripped so that the mouth of the bag is unobstructed;
(b) providing a rod conveyor having a gap where there are no rods;
(c) delivering a first bag to a first position under the upper run of the conveyor;
(d) gripping the lip of the first bag and pulling the first bag through said gap to a second position at least partially on the conveyor;
(e) delivering a second bag to the first position under the upper run of the conveyor while
(f) opening and loading the first bag; and,
(g) conveying the loaded first bag away while pulling the second bag through the gap to the second position to be loaded.

5. The method of claim 4 wherein the bags are side-seal bags and a first plurality of bags is substituted for the first bag and a second plurality of bags is substituted for the second bag.

6. Apparatus for loading a product into a bag having a lip which can be gripped leaving the mouth unobstructed comprising:
(a) a rod conveyor having a gap where there are no rods;
(b) means for delivering a bag to a first position below the upper run of the conveyor;
(c) means for gripping the lip of the bag at the first position and for pulling the bag through the gap in the conveyor to a second position where the bag is at least partially on the conveyor;
(d) means for opening the bag; and,
(e) means for placing a product in the opened bag.

7. The apparatus of claim 6 wherein means (b) through (e) are means respectively for delivering, gripping, opening and placing a product in a plurality of bags.

8. Apparatus for simultaneously loading products into a plurality of side-seal bags delivered from a chain of such bags, each bags having a lip which can be gripped leaving the mouth unobstructed comprising:
(a) means for feeding a plurality of bags from the chain so that the plurality lies in a first horizontal means;
(b) roller means for separating the plurality of bags from the chain and for partially separating the bags within the plurality from each other;
(c) rod conveyor means for receiving bags to be loaded and for conveying loaded bags away, said rod conveyor having a gap where there are no rods;
(d) vacuum belt means for advancing the plurality of bags to a position below the upper run of the conveyor where said bags continue to lie in the first horizontal plane;
(e) gripper means for gripping the lips of each of the bags in said plurality and for pulling the bags through the gap is said conveyor to a second horizontal plane where at least part of each bag is in contact with the conveyor;
(f) pneumatic means for opening the bags;
(g) conveyor means for delivering products towards the opened bags; and,
(h) pusher means for pushing the products into the opened bags afterwhich the gripping means release the bags to be removed by the conveyor.

9. The apparatus of claim 8 wherein there are two bags in said plurality of bag.

10. The apparatus of claim 8 including product guide means to assist the pusher means in placing products in the bags.

* * * * *